US009388563B1

(12) United States Patent
Calini

(10) Patent No.: US 9,388,563 B1
(45) Date of Patent: Jul. 12, 2016

(54) FASTENER GUIDE AND METHOD FOR CONNECTING STRUCTURAL MEMBERS IN BUILDING STRUCTURES

(71) Applicant: Anthony J. Calini, Guilford, CT (US)

(72) Inventor: Anthony J. Calini, Guilford, CT (US)

( * ) Notice: Subject to any disclaimer, the term of this patent is extended or adjusted under 35 U.S.C. 154(b) by 0 days.

(21) Appl. No.: 14/854,529

(22) Filed: Sep. 15, 2015

Related U.S. Application Data

(63) Continuation-in-part of application No. 14/603,736, filed on Jan. 23, 2015, now Pat. No. 9,175,472.

(51) Int. Cl.

| | |
|---|---|
| ***E04B 1/38*** | (2006.01) |
| ***E04C 5/00*** | (2006.01) |
| ***E04B 1/26*** | (2006.01) |
| ***E04B 1/41*** | (2006.01) |

(52) U.S. Cl.
CPC ..... *E04B 1/2608* (2013.01); *E04B 1/40* (2013.01); *E04B 2001/2644* (2013.01); *E04B 2001/405* (2013.01)

(58) Field of Classification Search
CPC ..... E04B 7/045; E04B 1/40; E04B 2103/06; E04B 2001/405; E04C 3/12
USPC ..... 52/698
See application file for complete search history.

(56) References Cited

U.S. PATENT DOCUMENTS

| | | | | |
|---|---|---|---|---|
| 797,474 | A | 8/1905 | Walker | |
| 1,657,243 | A | 1/1928 | Daniels | |
| 2,354,801 | A | 8/1944 | De Huff | |
| 2,477,163 | A | 7/1949 | Barnett | |
| 2,611,160 | A | 9/1952 | Hanesse | |
| 3,031,727 | A | 5/1962 | Nesbitt | |
| 3,184,800 | A | 5/1965 | Nelson | |
| 3,333,875 | A | 8/1967 | Tracy | |
| 3,423,898 | A | 1/1969 | Tracy | |
| 3,749,428 | A | 7/1973 | Hustead | |
| 3,844,548 | A * | 10/1974 | Rogers | B23Q 35/46 269/905 |
| 3,967,908 | A | 7/1976 | Snow | |
| 4,007,573 | A * | 2/1977 | Gilb | E04B 1/2608 403/188 |
| 4,015,399 | A | 4/1977 | Prins | |
| 4,410,294 | A | 10/1983 | Gilb et al. | |
| 4,414,785 | A | 11/1983 | Howell | |
| 4,449,335 | A | 5/1984 | Fahey | |
| 4,640,019 | A * | 2/1987 | Paley | E05B 17/06 33/197 |

(Continued)

FOREIGN PATENT DOCUMENTS

| | | | | |
|---|---|---|---|---|
| DE | 3821683 A1 * | 3/1990 | ..... | E04B 1/4121 |

*Primary Examiner* — Joshua J Michener
*Assistant Examiner* — Keith Minter
(74) *Attorney, Agent, or Firm* — DeLio, Peterson & Curcio LLC; David R. Pegnataro

(57) ABSTRACT

A fastener guide for accurate spacing and aligning of fastening means in light wood frame construction, comprising a vertical leg comprising a generally flat rigid material and including a plurality of through-holes spaced according to a calculated matrix for driving fasteners therethrough to secure a first structural member to a second structural member, and a flange attached to or integral with the vertical leg and positioned approximately at a right angle thereto. The fastener guide is placed against a face of the first structural member such that the vertical leg plurality of through-holes are positioned to allow for transfer of thrust, tension and shear forces to the second structural member oriented adjacent thereto at a building frame joint. Fasteners are driven through the plurality of through-holes into the second structural member to secure the first structural member to the second structural member.

6 Claims, 10 Drawing Sheets

(56) References Cited

U.S. PATENT DOCUMENTS 4,669,235 A 6/1987 Reinen
4,969,273 A * 11/1990 Richards ..... A47G 1/205 33/197
4,976,085 A 12/1990 Krueger
4,998,355 A * 3/1991 Greene ..... B25H 7/00 33/194
5,109,646 A 5/1992 Colonias et al.
5,230,198 A 7/1993 Callies
5,335,469 A 8/1994 Stuart
5,410,854 A * 5/1995 Kimmell ..... E04B 1/2068 411/465
5,561,949 A 10/1996 Knoth
5,572,840 A * 11/1996 Fast ..... E06B 1/62 49/504
5,857,295 A * 1/1999 Mikawa ..... E04B 7/045 52/656.9
5,910,085 A * 6/1999 Pruett ..... E04G 23/02 52/282.4
6,125,594 A * 10/2000 Hudson ..... E04B 1/2403 52/238.1
6,176,057 B1 * 1/2001 Bouchet ..... E04B 2/80 52/149
6,230,466 B1 * 5/2001 Pryor ..... E04B 1/2612 403/231
6,295,781 B1 10/2001 Thompson
6,311,449 B1 * 11/2001 Morse ..... E04B 1/003 52/236.9
6,494,551 B1 * 12/2002 Markley ..... A47B 88/044 312/334.7
6,655,096 B1 * 12/2003 Pryor ..... E04B 7/045 52/712
6,837,019 B2 1/2005 Collie
6,922,967 B2 8/2005 Collie
6,931,813 B2 8/2005 Collie
7,316,098 B1 1/2008 Sackett
7,707,785 B2 * 5/2010 Lin ..... E04B 7/045 52/289
7,891,144 B2 * 2/2011 Gilstrap ..... E04B 7/045 52/712
7,918,054 B2 * 4/2011 Grafton ..... E04B 7/02 248/291.1
7,971,410 B2 7/2011 Jerke
7,987,636 B2 8/2011 Hunt
8,590,256 B2 11/2013 Kawai et al.
8,733,061 B1 * 5/2014 McDonald ..... E04B 7/045 52/300
8,850,774 B2 * 10/2014 Kempf ..... B66C 3/00 52/167.1
2005/0066613 A1 * 3/2005 Bourque ..... E04B 1/003 52/712
2005/0072099 A1 * 4/2005 Roesset ..... E04B 1/2608 52/633
2006/0059794 A1 * 3/2006 Gilstrap ..... E04B 7/045 52/90.1
2006/0130414 A1 * 6/2006 Walther ..... E04B 1/003 52/289
2006/0150564 A1 7/2006 Dufault
2006/0254192 A1 * 11/2006 Fennell ..... E04B 7/02 52/699
2007/0007407 A1 * 1/2007 Valenziano ..... A61L 9/20 248/205.1
2008/0244993 A1 10/2008 Crumley
2010/0166497 A1 * 7/2010 Vilasineekul ..... E04B 1/2604 403/205
2011/0225924 A1 9/2011 Carbonaro et al.
2013/0075558 A1 * 3/2013 Houser ..... E05F 3/227 248/224.8
2014/0318076 A1 * 10/2014 Tan ..... E04B 1/2608 52/712
2015/0096165 A1 * 4/2015 Hutchinson ..... E04B 1/185 29/525.01
2015/0184371 A1 * 7/2015 Stauffer ..... E04B 1/40 52/701

* cited by examiner

FASTENER GUIDE AND METHOD FOR CONNECTING STRUCTURAL MEMBERS IN BUILDING STRUCTURES

RELATED APPLICATIONS

This application is a continuation-in-part of U.S. patent application Ser. No. 14/603,736 filed on Jan. 23, 2015.

BACKGROUND OF THE INVENTION

1. Field of the Invention

The present invention relates to a fastener guide for accurate spacing and aligning of fastening means in light wood frame construction and a method for connecting structural members at various building joints. Specifically, the present invention relates to a fastener guide which includes a plurality of through-holes spaced according to a calculated matrix for driving fasteners therethrough to secure at least two structural members together at a building joint. The fastener guide is placed against a face of the first structural member such that the plurality of through-holes are positioned to allow for transfer of thrust, tension and shear forces to a second structural member which is oriented adjacent thereto, in accordance with accepted industry and building code requirements. Fasteners are driven through the plurality of through-holes into the second structural member to secure the joint.

2. Description of Related Art

Light frame building construction is the predominant method of construction in the residential and light commercial construction market. Many different connectors are used in the art for joining structural members for construction of a building frame, and these different connectors are designed to secure rafters or other structural members to an adjacent structural member of a building structure, often at a unique angle of attachment. The connectors are typically provided with through-holes for fasteners to be driven through the connector and into the side faces of the structural members being connected. In addition, connectors for securing structural members must be designed for withstanding upward and lateral loads developed by high winds, which can differ by geographic location, and may include hurricane forces.

The prior art has provided numerous configured connectors to secure structural members to one another, particularly in the area of rafter-joist-wall attachments; however, each has various disadvantages which impede the connector's effectiveness. Some disadvantages include prohibiting flush contact with or not allowing for direct full surface contact between adjacent structural members and thereby lacking a provision for transferring thrust, tension and shear forces to connected members in accordance with building code requirements, or requiring field bending of the connector which inhibits proper fastener placement. Current connectors are required to be hammered into place to develop contact surfaces, and the shape of these connectors directs the transferred load to the edge of the wall plate instead of to the top of the wall plate. Others require the connector to be in place prior to placing rafters.

The present invention overcomes the disadvantages of the prior art by providing a fastener guide that includes pre-sized and pre-positioned through-holes which are calculated to meet design and building code requirements for transferring thrust, tension and shear forces to connected members when fasteners are driven therethrough. The guide layout ensures that fasteners will be placed to meet spacing and positioning requirements in each direction in accordance with the building codes, without the need for any code interpretation, hand layout or field bending by the craftsman. Further, in contrast to the connectors of the prior art, the fastener guide of the present invention is a non-structural device, therefore it can be removed and discarded after the installation of fasteners without effecting load or the transfer of various forces between the connected members, or can be left in place, if desired.

Other advantages of the present invention include a reduction in the time required to secure each building joint by, including but not limited to, eliminating the need for interpretation of building code tables for fastener layout, as well as eliminating the time-consuming dimensional hand layout by the craftsman in the field for fastener placement on every related structural member.

SUMMARY OF THE INVENTION

Bearing in mind the problems and deficiencies of the prior art, it is therefore an object of the present invention to provide a fastener guide for accurate spacing and aligning of fastening means for securing a first structural member to a second structural member at a building joint.

It is another object of the present invention to provide a fastener guide for the proper layout and spacing of fasteners to meet design and building code requirements.

It is yet another object of the present invention to provide a fastener guide which ensures proper fastener positioning for transferring thrust, tension and shear forces to connected structural members for providing load capacities as required by building codes.

It is still yet another object of the present invention to provide a method for connecting structural members in building structures wherein fasteners are positioned to allow for transfer of thrust, tension and shear forces to the second structural member in accordance with building code requirements.

It is still yet another object of the present invention to provide a method for connecting structural members in building structures which eliminates the need for code interpretation by the craftsman in the field.

It is yet another object of the present invention to provide a method for connecting structural members in building structures which prevents layout errors by the craftsman and ensures proper connections.

Still other objects and advantages of the invention will in part be obvious and will in part be apparent from the specification.

The above and other objects, which will be apparent to those skilled in the art, are achieved in the present invention which is directed to a fastener guide for accurate spacing and aligning of fastening means in light wood frame construction, comprising a vertical leg comprising a generally flat rigid material and including a plurality of through-holes spaced according to a calculated matrix for driving fasteners therethrough to secure a first structural member to a second structural member, and a flange attached to or integral with the vertical leg and positioned approximately at a right angle thereto. The fastener guide is placed against a face of the first structural member such that the vertical leg plurality of through-holes are positioned to allow for transfer of thrust, tension and shear forces to the second structural member when fasteners are driven through the plurality of through-holes into the second structural member.

The plurality of through-holes may be oriented in a plurality of rows along a longitudinal axis of the fastener guide vertical leg and form a substantially pyramidal shape. Each through-hole may be spaced a first predetermined centerline distance S1 from each adjacent through-hole in the same row and a second predetermined centerline distance S2 from the adjacent through-hole in each adjacent row, the bottom row may be spaced a third predetermined centerline distance S3 from a bottom edge of the vertical leg, and the through-hole at the end of each row may be spaced a fourth predetermined centerline distance S4 from an adjacent end of the vertical leg, wherein S1, S2, S3 and S4 are calculated to allow for transfer of thrust, tension and shear forces from the first structural member to the second structural member when fasteners are driven through the plurality of through-holes. S1, S2, S3 and S4 may be calculated in accordance with International Residential Code®, International Building Code® and National Design Specification® for Wood Construction guidelines.

The fastener guide may be comprised of light gage sheet steel, aluminum, paper or paper-based composite material, or plastic or plastic-based composite material. The fastener guide may be non-structural and non-load bearing, and may remain in place against the face of the first structural member after fasteners are driven through the plurality of through-holes into the second structural member. The fastener guide vertical leg may include at least one placement tooth capable of piercing the first structural member having a penetrating dimension not exceeding a width of the first structural member. The fastener guide vertical leg may include an adhesive on at least one surface for securing the vertical leg to the face of the first structural member and a removable protective covering over the surface area which includes the adhesive, wherein the protective covering is removed prior to placement of the fastener guide against the face of the first structural member. The fastener guide may be fabricated opposite hand.

In another aspect, the present invention is directed to a method for connecting structural members in building structures comprising the steps of: providing a pair of structural members for connection as part of a building frame; orienting the pair of structural members at a building frame joint; and providing a fastener guide comprising a vertical leg comprising generally flat rigid material and including a plurality of through-holes spaced according to a calculated matrix for driving fasteners therethrough to secure the first structural member to the second structural member, and a flange attached to or integral with the vertical leg and positioned approximately at a right angle thereto. The method includes placing the fastener guide against a face of the first structural member such that the vertical leg plurality of through-holes are positioned to allow for transfer of thrust, tension and shear forces to the second structural member when fasteners are driven therethrough; and driving fasteners through the plurality of through-holes into the second structural member.

The plurality of through-holes may be oriented in a plurality of rows along a longitudinal axis of the fastener guide vertical leg and form a substantially pyramidal shape. Each through-hole may be spaced a first predetermined centerline distance S1 from each adjacent through-hole in the same row and a second predetermined centerline distance S2 from the adjacent through-hole in each adjacent row, the bottom row may be spaced a third predetermined centerline distance S3 from a bottom edge of the fastener guide vertical leg, and the through-hole at the end of each row may be spaced a fourth predetermined centerline distance S4 from an adjacent end of the fastener guide vertical leg, wherein S1, S2, S3 and S4 are calculated to allow for transfer of thrust, tension and shear forces from the first structural member to the second structural member when fasteners are driven through the plurality of through-holes. S1, S2, S3 and S4 may be calculated in accordance with International Residential Code®, International Building Code® and National Design Specification® for Wood Construction guidelines.

The fastener guide vertical leg may include at least one placement tooth capable of piercing the first structural member having a penetrating dimension not exceeding a width of the first structural member, and the method may further include the step of securing the framing member to the first structural member using the at least one placement tooth prior to driving fasteners through the plurality of through-holes into the second structural member.

The fastener guide vertical leg may include an adhesive on at least one surface for securing the vertical leg to the face of the first structural member and a removable protective covering over the surface area which includes the adhesive, wherein the protective covering is removed prior to placement of the fastener guide against the face of the first structural member, and the method may further include the step of securing the vertical leg to the first structural member using the adhesive prior to driving fasteners through the plurality of through-holes into the second structural member.

The method may further include the step of removing the fastener guide from the face of the first structural member after driving fasteners through the plurality of through-holes into the second structural member.

In yet another aspect, the present invention is directed to a fastener guide for accurate spacing and aligning of fastening means in light wood frame construction, comprising a generally flat rigid material including a plurality of through-holes spaced according to a calculated matrix for driving fasteners therethrough to secure a first structural member to a second structural member, wherein the fastener guide is placed against a face of the first structural member such that the plurality of through-holes are positioned to allow for transfer of thrust, tension and shear forces to the second structural member when fasteners are driven through the plurality of through-holes into the second structural member.

The plurality of through-holes may be oriented in a plurality of rows along a longitudinal axis of the fastener guide and form a substantially pyramidal shape. Each through-hole may be spaced a first predetermined centerline distance S1 from each adjacent through-hole in the same row and a second predetermined centerline distance S2 from the adjacent through-hole in each adjacent row, the bottom row may be spaced a third predetermined centerline distance S3 from a bottom edge of the fastener guide, and the through-hole at the end of each row may be spaced a fourth predetermined centerline distance S4 from the adjacent edge of the fastener guide, wherein S1, S2, S3 and S4 are calculated to allow for transfer of thrust, tension and shear forces from the first structural member to the second structural member when fasteners are driven through the plurality of through-holes. S1, S2, S3 and S4 may be calculated in accordance with International Residential Code®, International Building Code® and National Design Specification® for Wood Construction guidelines.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
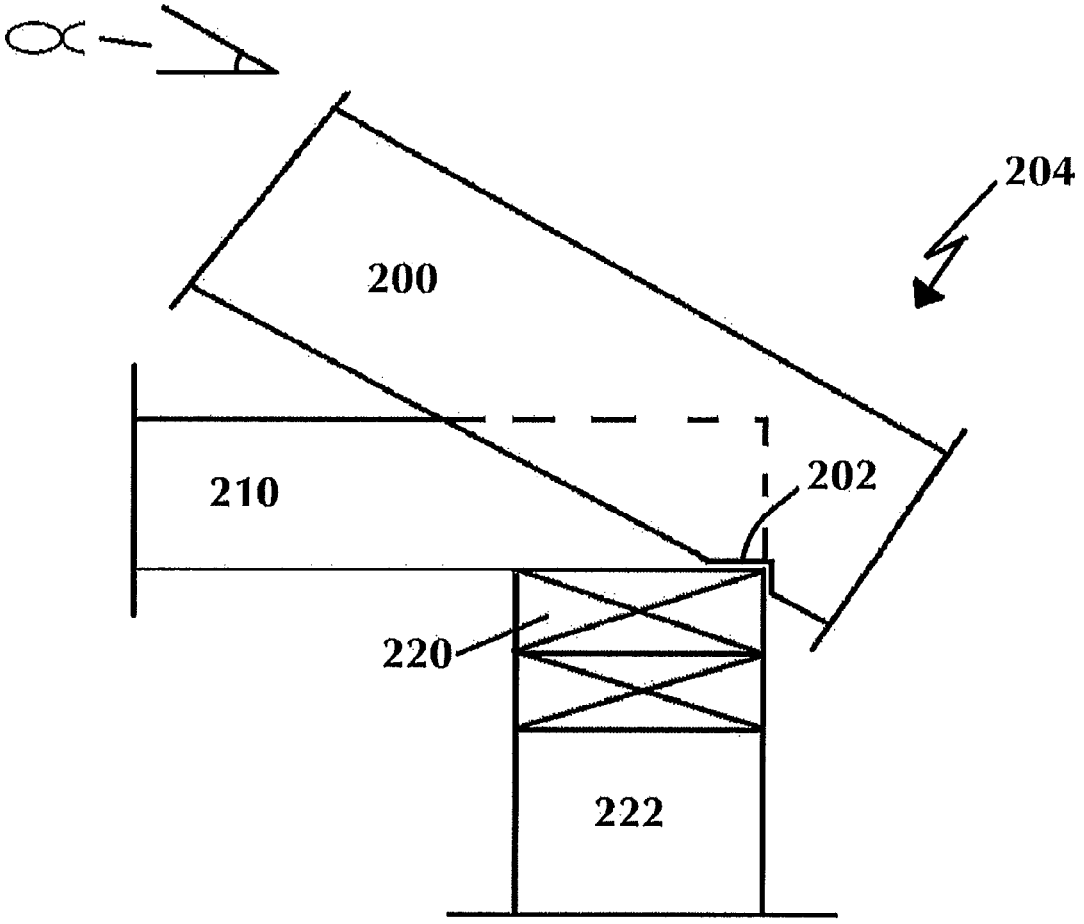
FIG. 1 (PRIOR ART)
FIG. 1 depicts a heel joint and a conventional birdsmouth cut or seat in a rafter of the prior art.

In describing the embodiments of the present invention, reference will be made herein to FIGS. 1-10B of the drawings in which like numerals refer to like features of the invention.

The fastener guide of the present invention addresses the connection of adjacent structural members in modern housing or light commercial construction, more particularly light wood frame construction. One such connection is the joint at the intersection of the roof rafter, joist/tie, blocking, wall plate and wall studs (i.e. where the roof bears on the supporting wall), which is commonly referred to as the "heel" joint. The heel joint is one of the most significant joints in the entire building structure, and represents the point where the roof's dead and live loads are combined with wind/hurricane loads, exposing the heel joint to uplift and overturning forces in all directions. It is at this connection that all imposed loads (dead & live loads, snow, plus wind/hurricane & seismic forces) are transferred from the roof to the supporting bracing wall system. Similar requirements are needed at other connections in the building frame, such as at the roof (e.g. connecting a rafter to a chord/tie), walls (e.g. at the top wall plate lap), or to secure beams (e.g. overlapping members), as will be discussed in more detail below.

The requirements for residential construction are provided in the International Residential Code®, International Building Code®, and National Design Specification® for Wood Construction, with reference to acceptable design institutes and associations. Presently, building codes provide information and tables stating the requirements for fastener size, layout, spacing, edge and end distance for given fastener sizes, for example, National Design Specification® for Wood Construction Table C11.1.6.6 entitled "Nail Minimum Spacing Table", which describes placement for various fastener sizes; International Residential Code® Table R802.5.1(9) entitled "Rafter/Ceiling Joist Heel Joint Connections," which describes the number and size of fasteners required for a given load, rafter span and rafter spacing; American Wood Council Wood Framing Construction Manual (WFCM) Table 3.9 entitled "Rafter/Ceiling Joist Heel Joint Connection Requirements", which states the required load capacity for various rafter spacing, slopes and spans; and International Building Code® Table 2308.10.4.1 entitled "Rafter Tie Connection", which states the number of fasteners required for various rafter spans, spacing and slopes. However, the codes do not provide a graphical or pictorial dimensional layout for the fasteners. It is then left to the craftsman in the field to interpret the required proper positioning and spacing for the fasteners in accordance with these requirements for each design loading condition, which leaves open the possibility of craftsman error and results in non-uniformity of positioning and spacing of fasteners and leads to splitting of the rafter (or other structural member), and further, most importantly, effects the required capacity to transfer thrust, tension and shear loads.

As an example, the important interface at the heel joint, wall plate and beam splice (fastener size, spacing and placement) is often not given the attention that is warranted in the field by the craftsman. This is partly due to the required code interpretation for each case and the actual time required for proper hand layout of fasteners at the face of each rafter, wall plate and beam splice. The craftsman must first interpret the building code table(s) for the heel joint based on the load, length and pitch of the rafter, then create a dimensional hand layout for fasteners for each related member, prior to installing the fasteners to secure the joint. Conventionally, mating an angled rafter securely with the top wall plate at the heel joint is achieved using a birdsmouth cut or seat in the rafter. The standard construction is to notch the bottom of the rafter with an angular cut to accommodate the selected roof pitch and having toe-nails to connect to the top wall plate. To assure proper fit, the joint requires a skilled carpenter for accuracy to provide a cut allowing for full surface contact between the bottom of the rafter and the top of the supporting wall plate. Further, "toe-nailing" of the rafter to the supporting wall plate is required, which leads to splitting at the rafter load bearing surface. These conditions weaken the carrying capacity of the joint.

The fastener guide of the present invention addresses this deficiency by providing a guide for proper placement of fasteners that ensures that fasteners will be placed to meet spacing and positioning requirements in each direction in accordance with the building codes, without the need for any code interpretation, hand layout or field bending by the craftsman. The fastener guide includes through-holes which are presized and arranged in a calculated matrix to meet accepted industry and building code requirements for transferring thrust, tension and shear forces to connected structural members, thereby eliminating the need for code interpretation by the craftsman in the field and preventing possible misinterpretation and layout errors, while ensuring proper connections and resulting in significant time and cost savings.

In at least one embodiment of the present invention, the fastener guide may be used for accurate spacing and aligning of fastening means for connecting a rafter to an adjacent joist/tie member at a heel joint. In other embodiments, the guide may be used with other structural members at various other building joints, such as at the roof (e.g. connecting a rafter to a chord/tie), walls (e.g. at the top wall plate lap), or to secure beams (e.g. overlapping members). A plurality of through-holes in the fastener guide are spaced according to a calculated matrix for driving fasteners therethrough to secure a first structural member to a second structural member at a building joint. The sizing and spacing of the fasteners is calculated in accordance with accepted industry and building code requirements for transferring thrust, tension and shear forces to the connected members. In at least one method, the fastener guide is placed against a face of the first structural member such that the plurality of through-holes are positioned to allow for transfer of thrust, tension and shear forces to the second structural member which is oriented adjacent thereto. Fasteners are then driven through the plurality of through-holes, through the first structural member and into the second structural member to secure the joint.

Certain terminology is used herein for convenience only and is not to be taken as a limitation of the invention. For example, words such as "upper," "lower," "left," "right," "horizontal," "vertical," "upward," and "downward" merely describe the configuration shown in the drawings. For purposes of clarity, the same reference numbers will be used in the drawings to identify similar elements.

Referring now to FIG. 1, a typical heel joint 204 of the prior art is shown, with a birdsmouth cut or seat 202 in a rafter 200. Rafter 200 is positioned at angle $\alpha$ to top wall plate 220. A birdsmouth cut 202 is an L-shaped notch with a horizontal and vertical component sized to fit on a top wall plate 220 (shown here as a double plate), which is supported by exterior stud 222. By virtue of the birdsmouth cut, the angled rafter has significantly more than a linear contact with the top wall plate. The surface area of the weight-bearing contact (the horizontal component of the birdsmouth cut) is extended by the birdsmouth cut. Adjacent joist/tie 210 (shown behind rafter 200 for illustrative purposes) extends laterally over top wall plate 220. At each rafter-joist-exterior stud wall junction, blocking (not shown, for clarity) is also typically attached. The rafter 200 is fastened to the adjacent joist/tie member 210 using fasteners (not shown) that should be placed in accordance with proper positioning and spacing that meet design and building code requirements and set by the craftsman in the field, and "toe-nailing" of the rafter to the supporting wall plate 220 is typically performed.

Figure 2:
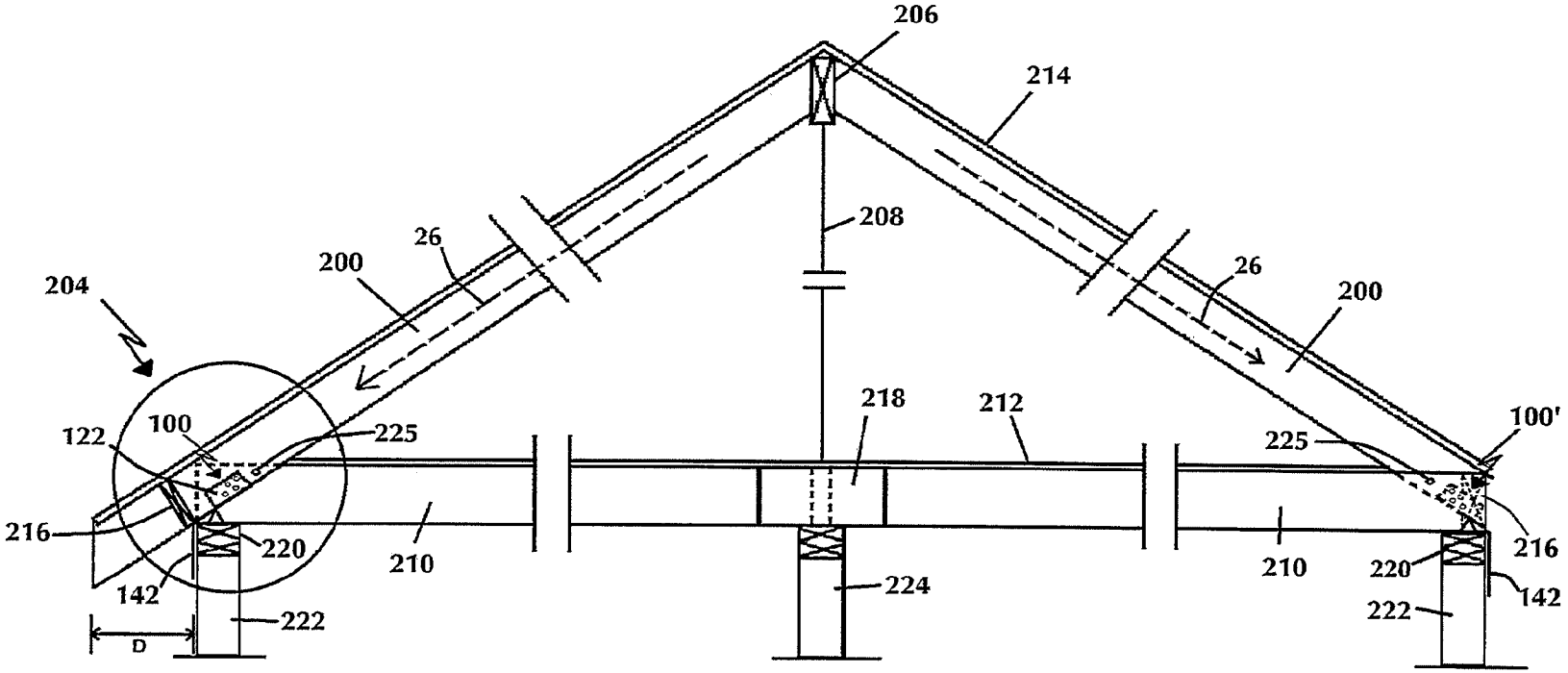
FIG. 2 depicts a conventional framing layout including a self-adjusting heel joint connector.

FIG. 2 depicts a conventional roof framing layout, including a self-adjusting heel joint connector 100. For exemplary purposes, FIG. 2 depicts two conventional roof designs in one building structure. On the left half of the structure is an overhanging roof design, where rafter 200 extends beyond the exterior stud 222 by an arbitrary, predetermined distance D. Alternatively, a conventional roof framing design may be a flush mounted design, wherein the rafter does not extend beyond the exterior stud, as shown on the right half of the structure in FIG. 2. Normally, either one design or the other would be used for a single construction; however, the combination of the two simultaneously in a single structure is also possible. Other roof framing designs may also be accommodated by the heel joint connector.

As shown in FIG. 2, rafters 200 extend at an angle from a top wall plate 220, shown here as a double plate, and are connected at an opposite end by a ridge board or beam 206, and temporary support 208 supports ridge 206. A rafter thrust force 26 emanates from the ridge 206 in the direction of the top wall plate 220, parallel to the grain of the wood rafter. Top wall plate 220 is generally supported by exterior stud 222. Adjacent joists/ties 210 extend horizontally from top wall plate 220. During placement of rafter 200, an erection fastener 225 is placed to tightly secure rafter 200 to joist/tie 210. Joist/tie 210 may be extended in length to offset splice member 218. Joist/tie 210 may further be supported by an interior partition 224, if such support is needed. Blocking 216 is placed perpendicular to the angled rafter 200 in an overhanging roof design (as in the left half of the structure), and perpendicular to the joist/tie member 210 in a flush mounted design (as in the right half of the structure), and is secured between each rafter and joist/tie. As shown in FIG. 2, flooring 212 may be installed on top of joist/tie 210, and structural roof sheathing 214 covers the rafters 200.

FIG. 2 further shows one embodiment of a self-adjusting heel joint connector 100, which has been slideably inserted and secured at heel joint 204. Heel joint connector 100 is designed to attach rafter 200, joist/tie 210, top wall plate 220, and exterior stud 222 in a single, self-adjusting construction design. As shown, the heel joint connector 100 has been slideably inserted and secured at the heel joint 204 between the bottom of rafter 200 and top wall plate 220 such that the vertical leg 122 of the framing member of the connector is in the foreground of FIG. 2 and the connector is fastened to rafter 200 and adjacent joist/tie 210, which is behind rafter 200.

As further shown in FIG. 2, a second self-adjusting heel joint connector 100', which has been fabricated "opposite hand," is slideably inserted and secured at the heel joint on the opposing side of the building structure, which in FIG. 2 includes a flush mounted design. The framing member of the heel joint connector is capable of being fabricated "opposite hand," which allows for the joist/tie members 210 to be aligned in the building structure and abut, and splice member 218 is then added. As shown in FIG. 2, a second heel joint connector 100' is slideably inserted and secured at the heel joint such that vertical leg of the framing member of the connector is behind rafter 200 and fastened to rafter 200 and adjacent joist/tie 210, which is in the foreground of FIG. 2. The rafter thrust forces 26 at each end of the building structure are transferred to the adjacent joist/tie members, which are aligned and connected by splice 218 to cancel out the opposing tension forces to complete the structural system. Whereas in a conventional framing layout of the prior art, the joist/tie members may overlap, which prevents the rafters from directly butting each other at the ridge, causing an eccentric load. Further, having the heel joint connectors directly in line on both sides of the structure and connected by a joist/tie splice member 218, as in FIG. 2, eliminates the need for permanent roof ridge supports, thus allowing for full open, unobstructed useable living space.

Figure 3:
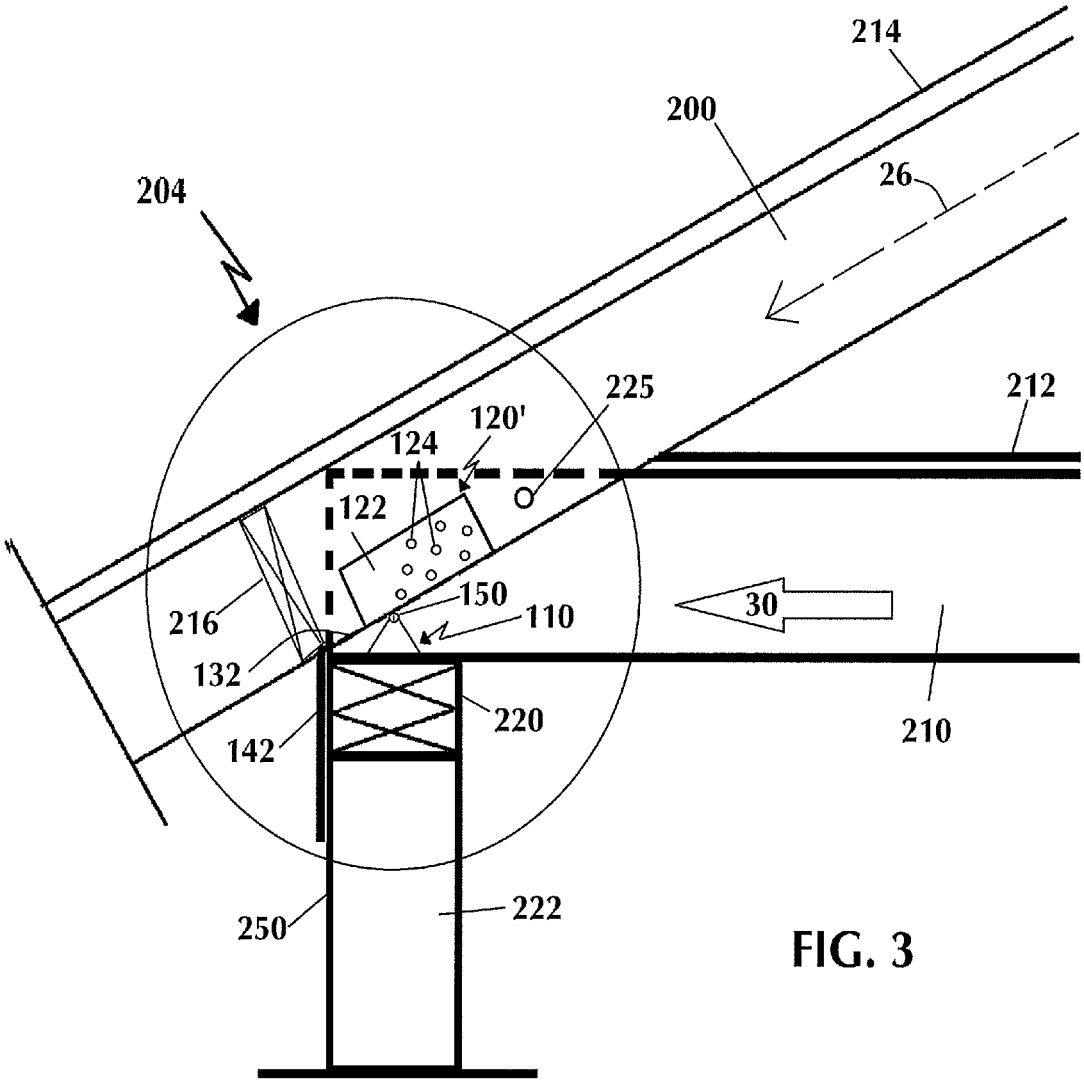
FIG. 3 depicts a magnified view of the heel joint 204 shown in FIG. 2.

FIG. 3 shows a magnified view of the heel joint 204 of FIG. 2, in which the heel joint connector has been slideably inserted and secured at heel joint 204 in the direction of arrow 30. As shown in FIG. 3, the self-adjusting heel joint connector includes a framing member 120' secured to rafter 200 at a precise preset pitch using fasteners (not shown) driven through a plurality of through-holes 124. Framing member 120' is freely rotatable (prior to and during placement) and rotatably secured about swivel joint 150 to a support member 110 secured to the top of supporting wall plate 220 using fasteners driven through a plurality of through-holes (not shown). Framing member 120' includes a vertical leg 122 and a horizontal leg 132 having a tab 142 which is field folded in the direction of the exterior face 250 of exterior stud 222 and secured to the side of top wall plate 220 and stud 222 using fasteners (not shown). Vertical leg 122 is flush with the surface of the rafter 200 opposite joist/tie member 210, and rafter 200 is supported by horizontal leg 132. By also securing the connector to the side of the supporting wall plate 220 and stud 222 using tab 142, additional anchorage is created against uplift forces.

Figure 4:
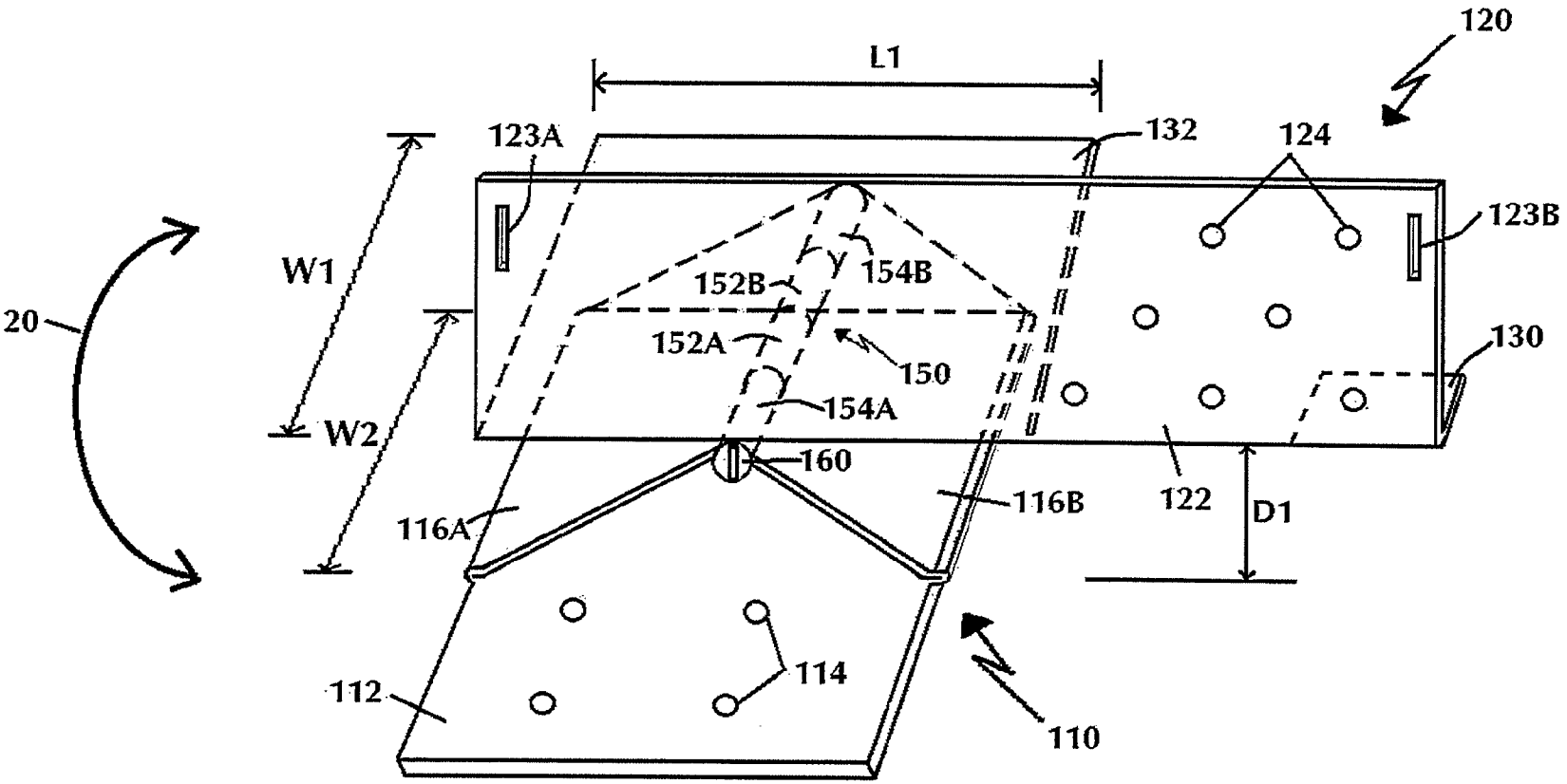
FIG. 4 depicts a perspective view of an embodiment of a self-adjusting heel joint connector, wherein the framing member and support member are each formed from bent sheet metal.

FIG. 4 shows a perspective view of one embodiment of a self-adjusting heel joint connector. As shown in FIG. 4, the self-adjusting heel joint connector includes a framing member 120 rotatably secured to a support member 110 about a swivel joint 150. The individual components of the self-adjusting heel joint connector are preferably each fabricated from a flat section of light gage metal steel, or other solid, bendable material resilient enough to attach the structural members for building construction and to withstand enhanced load forces. Alternatively, each of the support member or framing member may be fabricated from materials other than light gage steel, such as cast steel, forged metal or the like, so long as the separate components are attachable in a structurally sound manner that ultimately performs the function of the heel joint connector as described. The attachment of the structural members (rafter, joist/tie, wall plate, and exterior stud) is preferably achieved by employing fasteners, such as screws, nails, bolts and the like, driven through pre-punched through-holes in the framing member and support member, respectively, and into the face of the rafter and the top of the supporting wall plate and exterior stud.

As depicted in FIG. 4, support member 110 has a flat base surface 112 for securing the support member to a top supporting wall plate (not shown). The support member for the swivel joint may include extended portions integral with or attached to, and extending from, the flat base surface 112 and disposed in the direction of the swivel joint 150, to offset the swivel joint from the flat base surface. As shown in FIG. 4, support member 110 includes side extended portions 116*a*, 116*b* having a width W2 which are integral with the flat base surface 112 and extend from opposing edges of the flat base surface in the direction of swivel joint 150 to form a triangular cross-section. This enables swivel joint 150 to be offset an arbitrary distance D1 from the flat base surface 112 of the support member 110, and allows for free rotation of the framing member 120 about swivel joint 150 in the direction of arrow 20 during placement of the heel joint connector. If the support member were formed from forged metal or cast steel, instead of a flat sheet of gage metal steel, as shown in FIG. 4, the cross-section of the support member, while still triangular, may instead be solid.

Other embodiments of the support member are not precluded, such as a pair of extended portions positioned plumb and disposed from a midpoint of the flat base surface, or a single, solid extended portion disposed from a midpoint of the flat base surface. Those skilled in the art should appreciate that any orientation of the extended portion(s) disposed from the flat base surface of the support member may be used, so long as the extended portion(s) enable the swivel joint to be offset a distance from the flat base surface of the support member to allow for free rotation of the framing member with respect to the support member about the swivel joint, within a predetermined rafter pitch range, during placement of the connector.

Referring again to FIG. 4, the flat base surface 112 has a plurality of through-holes 114 allowing for fasteners (not shown) to be inserted or driven therethrough to secure the support member 110 to a top supporting wall plate (not shown). The support member may be placed and fastened to various materials, including wood, masonry, concrete, steel and the like. Preferably, the fasteners may be nails, screws, bolts or other similar fastening means, but may be any type of appropriate fastener to mate with the type of material comprising the top supporting wall plate. The number of through-holes required to secure the support member 110 to a top supporting wall plate is shown as four, for illustrative purposes only. Those skilled in the art should appreciate that the size, quantity and placement of fasteners (and corresponding through-holes) is design-dependent to ensure for maximum securing strength while minimizing lateral movement or racking, and the connector is not limited to the size, number or location of through-hole placement, as shown.

As further depicted in FIG. 4, swivel joint 150 may be comprised of a plurality of mutually-aligned mounting loops 152*a*, 152*b*, 154*a*, 154*b* offset from flat base surface 112 and the bottom of framing member horizontal leg 132, respectively. Framing member 120 is freely rotatable about swivel joint 150 with respect to the support member 110 in the direction of arrow 20, within a predetermined rafter pitch range. This allows the heel joint connector to self-adjust to the precise pitch of the rafter during the placing process, providing for full surface contact and load transfer. The design of the connector is such that the connector can provide for a pitch range of 4/12 to 12/12 (and the infinite fractions in between) for a conventional 2×4 wall plate, and 2/12 to 12/12 (and the infinite fractions in between) for a conventional 2×6 wall plate.

As further shown in FIG. 4, framing member 120 has a vertical leg 122 and a horizontal leg 132, which is attached to or integral with vertical leg 122 and is positioned approximately at a right angle to vertical leg 122. A rafter (not shown) is preferably fit between the vertical and horizontal legs of the framing member such that the bottom of the rafter is substantially flush with and supported by the horizontal leg 132 and vertical leg 122 is substantially flush with the surface of the rafter opposite an adjacent joist/tie member. Framing member horizontal leg 132 has length L1 and width W1, and the width W1 of horizontal leg 132 is approximately equal to the width W2 of extended portions 116*a*, 116*b*. The width W1 of horizontal leg 132 may vary in accordance with the width of the rafter(s) which it supports; however, the width W2 of extended portions 116*a*, 116*b* will always be approximately equivalent to the width W1 of the horizontal leg 132. Alternatively, multiple rafters may also be supported by one framing member, wherein the rafters are positioned adjacent and flush with each other.

Vertical leg 122 includes a plurality of through-holes 124 allowing for fasteners to be inserted or driven therethrough to secure the framing member 120 to a rafter and an adjacent joist/tie member. The number of through-holes required to secure the framing member to the rafter and joist/tie is shown as seven for illustrative purposes only, as the number of fasteners (and corresponding through-holes) needed may be more or less than seven, based upon the rafter thrust force. The size, placement and spacing of the fasteners is crucial for providing the full intent of the heel joint connector, which includes allowing for the rafter thrust force to be transferred to the adjacent joist/tie member. The sizing and spacing of the through-holes 124 (with corresponding fasteners) will be discussed in further detail below in relation to embodiments of the present invention shown in FIGS. 7 through 10B.

Referring again to FIG. 4, in at least one embodiment of the heel joint connector, framing member vertical leg 122 may include one or more placement teeth 123*a*, 123*b* near either edge of the vertical leg 122 for piercing the rafter to provide temporary stability while the rafter is fastened to the adjacent joist/tie member through the heel joint connector of the present invention. Framing member vertical leg 122 may also include a positioning tab 130 offset a predetermined distance from the framing member horizontal leg 132 and on the same plane as framing member horizontal leg 132. Positioning tab 130 provides additional positioning for a rafter fit between the vertical and horizontal legs of the framing member 120.

Figure 5:
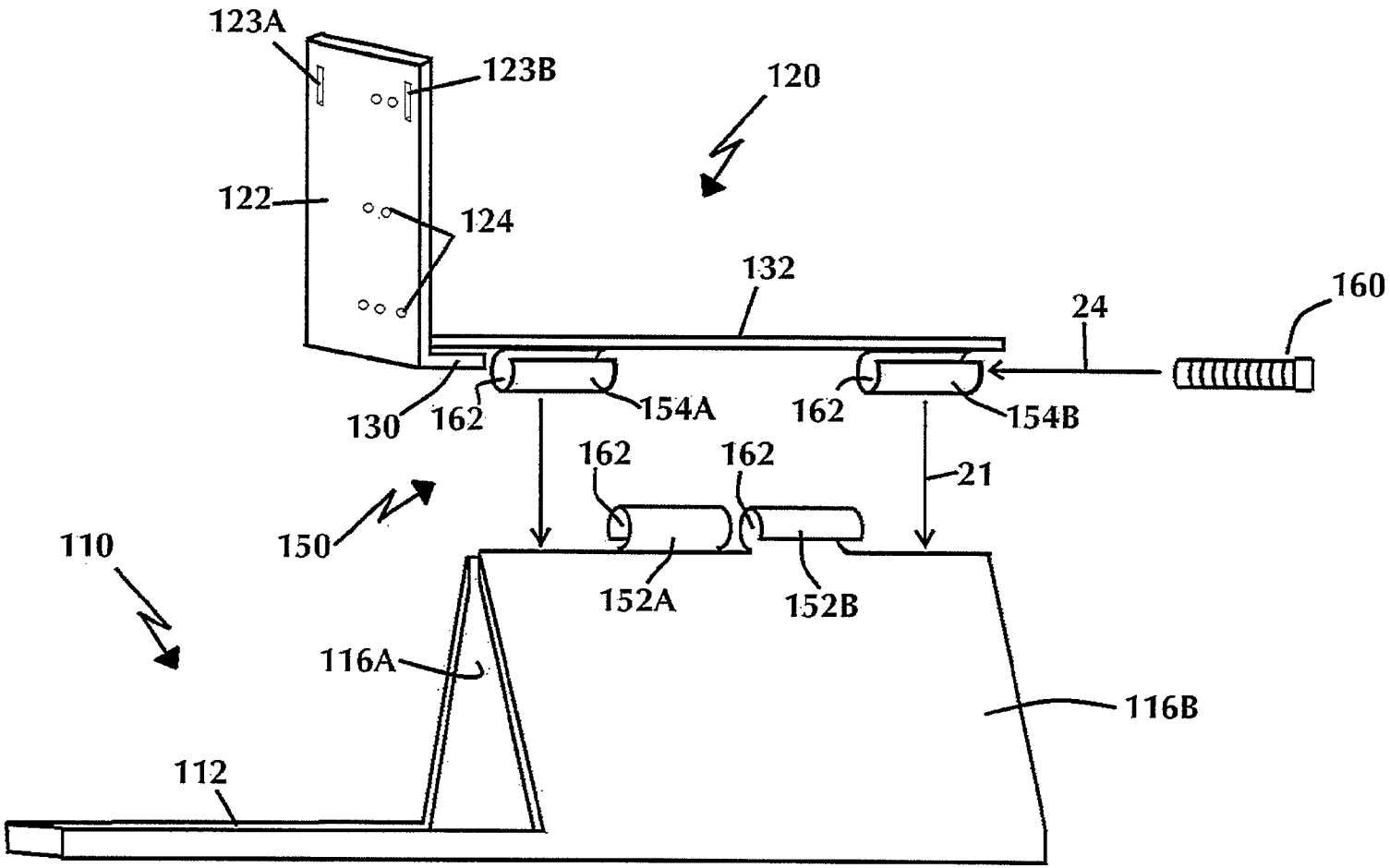
FIG. 5 depicts an exploded perspective view of the embodiment of the self-adjusting heel joint connector shown in FIG. 4.

FIG. 5 shows an exploded perspective view of the embodiment of the self-adjusting heel joint connector shown in FIG. 4. As depicted in FIG. 5, the swivel joint may be capable of receiving a pin connector 160 inserted therethrough. The ends of pin connector 160 may be flared during assembly of the connector to stay its position during rotation, and preferably, the ends of pin connector 160 are flush with the ends of swivel joint 150 so as to prevent interference with adjacent structural member(s) when the heel joint connector is being placed at a heel joint.

As further shown in FIG. 5, swivel joint 150 may be comprised of a plurality of mounting loops 152*a*, 152*b*, 154*a*, 154*b*, which are mutually aligned to allow for insertion of a pin connector 160 therethrough. As depicted in FIG. 5, framing member 120 and support member 110 are each fabricated from a single sheet of light gage metal. Mounting loops 152*a*, 152*b* are integral with support member 110, and mounting loops 154*a*, 154*b* are integral with framing member 120, and all mounting loops are formed to accommodate the insertion of pin 160 therethrough. When framing member 120 is mated with support member 110 in the direction of arrow 21, mounting loops 152*a*, 152*b*, 154*a*, 154*b* are aligned to form a channel 162 for insertion of pin connector 160 in the direction of arrow 24.

Figure 6B:
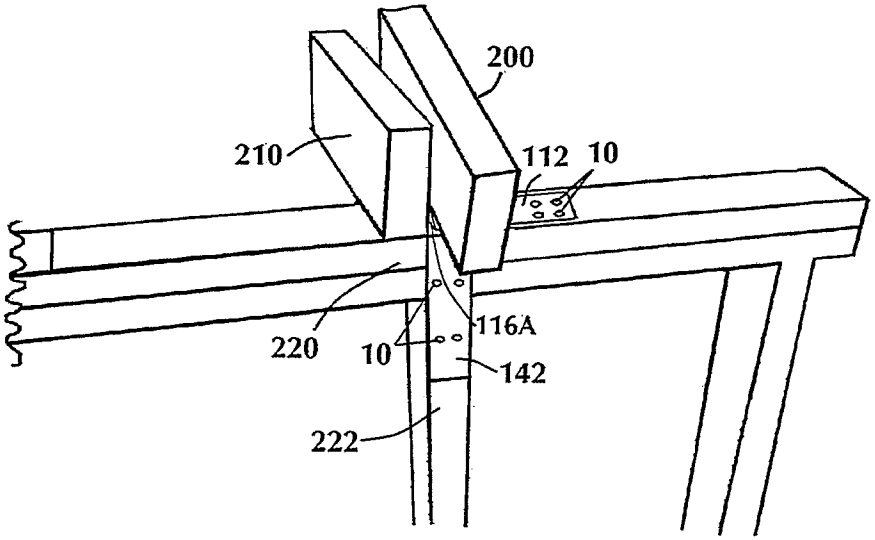
FIG. 6B depicts a perspective view of the heel joint shown in FIG. 6A.
Figure 6A:
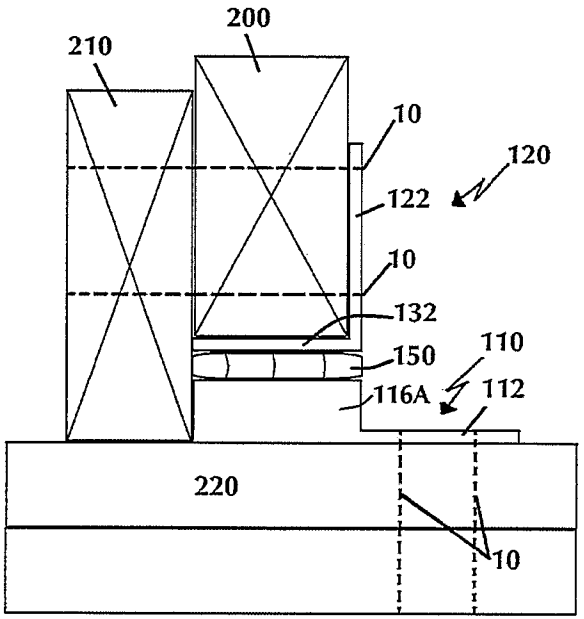
FIG. 6A depicts a cross-sectional view of a heel joint including a self-adjusting heel joint connector.

FIG. 6A depicts a cross-sectional view of a typical heel joint including a self-adjusting heel joint connector secured therein. As shown in FIG. 6A, support member 110 is secured to top wall plate 220 (shown here as a double plate) by way of fasteners 10 driven through a plurality of through-holes (not shown) in flat base surface 112. Framing member 120 is rotatably secured to support member 110 about swivel joint 150, which is offset from flat base surface 112 by extended portions 116*a* and 116*b* (not shown). Framing member 120 is secured to angled rafter 200 at a preset rafter pitch by fasteners 10 inserted through properly-positioned through-holes (not shown) in framing member vertical leg 122, which is flush against the surface of rafter 200 opposite joist/tie 210. The fasteners 10 protrude through rafter 200 and into adjacent joist/tie 210, which extends laterally above and perpendicular to top wall plate 220. Rafter 200 sits substantially flush against framing member vertical leg 122 and the top surface of framing member horizontal leg 132.

FIG. 6B shows a perspective view of the heel joint shown in FIG. 6A. FIG. 6B further shows a framing member including a tab 142 integral with the horizontal leg which has been folded downward in the direction of exterior stud 222 and secured to the side of top wall plate 220 and the outside face of exterior stud 222 using a plurality of through-fasteners 10. As shown in FIG. 6A and further shown in FIG. 6B, the connector enables angled rafter 200 to remain flush against the surface of adjacent joist/tie 210 after placement, while transferring full vertical rafter load through the connector directly to the top of the supporting wall plate and providing increased lateral structural stability. In that the connector has no protrusions or projections extending between the rafter and the adjacent joist/tie member, the connector allows the rafter 200 to be placed flush against the joist/tie member 210 for full surface contact, such that the fasteners are capable of providing full capacity for load transfer. Moreover, the flush contact between the rafter 200 and joist/tie 210 allows for complete transfer of the rafter thrust force to the joist/tie, as required to complete the structural system, as shown in FIG. 2.

The vertical leg of the framing member of the heel joint connector includes a plurality of through-holes which are pre-sized, pre-positioned and spaced according to a calculated matrix to ensure proper fastener placement in accordance with building code requirements. For a heel joint, this ensures that as the connector framing member rotates about the swivel joint to self-adjust to the precise preset rafter pitch during placement of the connector, such as adjusting between a pitch of 4/12 to a pitch of 12/12, the position of the through-holes (and thereafter, the location of the fasteners) will correspondingly reposition to be perpendicular to the rafter thrust force (i.e. parallel to the grain of the wood) and the tension force in the joist/tie member, to allow for transfer of the thrust force to the adjacent joist/tie member when fasteners are driven therethrough. This results in a time savings in the field and, more so, prevents possible misinterpretation and layout errors by the craftsman.

Even if the conventional heel joint construction generally performed in the prior art is used (i.e. mating an angled rafter securely with the top wall plate at the heel joint using a birdsmouth cut or seat in the rafter and thereafter "toe-nailing" the rafter to the supporting wall plate), the provisions for transferring rafter thrust force to the joist/tie member must still be provided for, unless the ridge member is permanently supported.

In such an event, in at least one embodiment of the fastener guide of the present invention, the framing member of a heel joint connector may be detached from the support member and used as a fastener guide for the craftsman in the field to determine proper fastener placement. Without the normally-attached support member, the framing member is non-structural and non-load bearing, and can therefore be removed and discarded after installation of the fasteners at the designated positions, if desired. One embodiment of the fastener guide of the present invention, wherein the connector framing member has been detached from the support member and swivel joint, is shown in FIG. 7.

Figure 7:
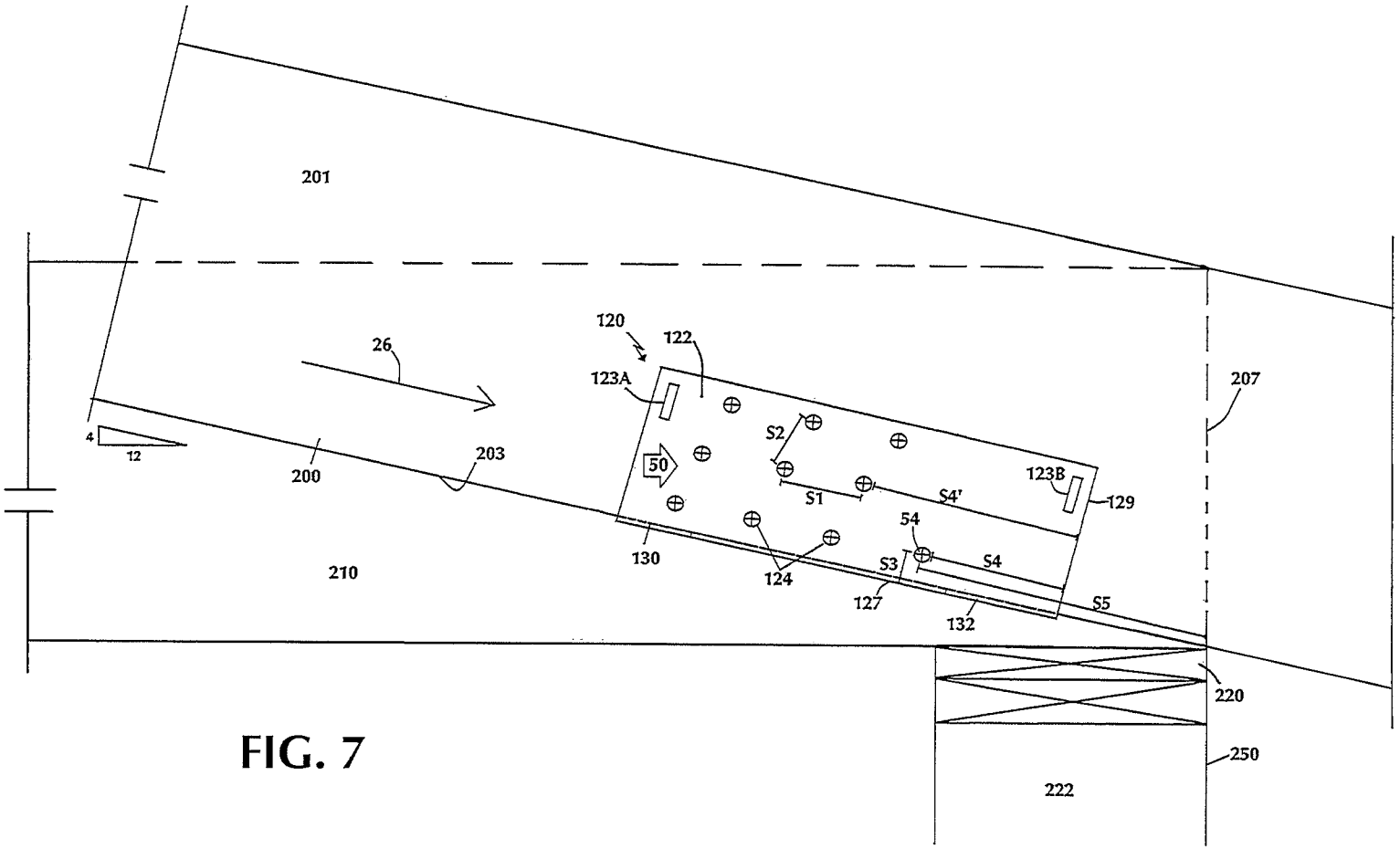
FIG. 7 depicts one embodiment of the fastener guide of the present invention, wherein the framing member of a self-adjusting heel joint connector is used as a fastener guide to set where fasteners are to be properly fastened through a rafter into an adjacent joist/tie member in accordance with building code requirements.

As shown in FIG. 7, the vertical leg 122 of framing member 120 may be fabricated to include different sets 50 of pre-punched through-holes 124. In one embodiment, a craftsman in the field may use the framing member 120 as a guide for the proper placement of fasteners (as further described below) by placing the vertical leg 122 of the framing member 120 flush against the rafter face 201 at the heel joint (where the rafter overlaps with the adjacent joist/tie member), and driving fasteners through the plurality of through-holes 124 through rafter face 201 and into the adjacent joist/tie member 210 at the proper markings 54. The fastener guide, i.e. framing member 120, may remain in place after driving fasteners therethrough, or may be removed as the guide is non-structural and non-load bearing. In other embodiments, the craftsman may use the fastener guide simply to score or mark the rafter through each designated through-hole 124, before removing the fastener guide and driving fasteners through the designated markings.

For a fastener guide at a heel joint, the size, spacing and position of each through-hole 124 in each set 50 are positioned so as to ensure that when the rafter pitch varies, the compression and tension forces on the fasteners remain perpendicular to the wood grain in both the rafter 200 and the adjacent joist/tie member 210 and the pre-designed load capacity is achieved. As shown in FIG. 7, the plurality of pre-punched through-holes 124 in set 50 may be oriented in a plurality of rows along a longitudinal axis of the vertical leg 122 to form a substantially pyramidal shape when viewed in a direction normal to the longitudinal axis of the vertical leg 122. Each through-hole 124 is spaced a predetermined centerline distance S1 from each adjacent through-hole 124 in the same row, and each row is spaced a predetermined centerline distance S2 from its adjacent rows, wherein S1 is not equal to S2. The bottom row of through-holes 124 is spaced a predetermined centerline distance S3 from the bottom edge 127 of vertical leg 122, in accordance with design requirements. The through-hole 124 in each row that is closest to the heel joint (when the vertical leg 122 is positioned against the rafter face 201 as a guide) is spaced a distance from the side 129 of vertical leg 122, such that when the guide is positioned by the craftsman, the through-hole 124 that is closest to the heel joint in each row (and thereafter the fastener driven through the corresponding marking 54) is positioned a predetermined centerline distance S5 from the end 207 of joist 210, in accordance with design requirements. As shown in FIG. 7, the required centerline distance between the through-hole 124 that is closest to the heel joint in each row and the end 207 of joist 210 varies and is dependent upon the rafter pitch, such as a distance S5 for a rafter set at a pitch of 4/12. The required centerline distance decreases as the rafter pitch increases. For a rafter set at a pitch of 12/12, for example, the required centerline distance between the through-hole 124 that is closest to the heel joint in each row and the end 207 of joist 210 would be a distance shorter than distance S5. As further shown in FIG. 7, the distance from the side 129 of vertical leg 122 to the closest through-hole 124 in each row increases for each row beginning from the bottom row, such as between a distance S4 (for the bottom row) and a distance S4' (for the row adjacent to the bottom row), to enable proper fastener placement. The spacing layout of the fasteners is primarily determined by the diameter of the fastener used.

As the fastener guide is positioned by the craftsman against the face 201 of the rafter at the precise preset rafter pitch (such as rafter 200 at 4/12, as shown in FIG. 7), the position of the through-holes 124 (and thereafter, the location of the fasteners) will correspondingly re-position to be perpendicular to the rafter thrust force 26 (i.e. parallel to the grain of the wood) and the tension force in the joist/tie member 210, to allow for transfer of the thrust force 26 to the adjacent joist/tie member 210 when fasteners are driven therethrough. Those skilled in the art should appreciate that the size and spacing of the through-holes will vary based upon the type and size of fastener used, as required for a range of designed load capacities.

Figure 8B:
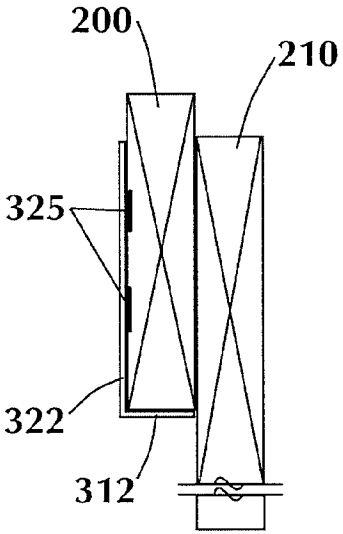
FIG. 8B depicts a side view of a heel joint including the fastener guide of the present invention as shown in FIG. 8, set in place using adhesive strips.
Figure 8:
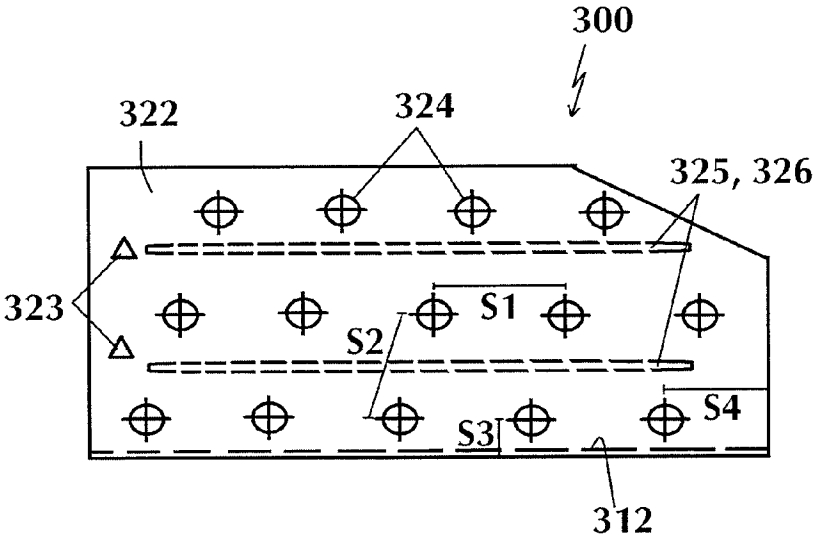
FIG. 8 depicts a plan view of another embodiment of the fastener guide of the present invention.
Figure 8A:
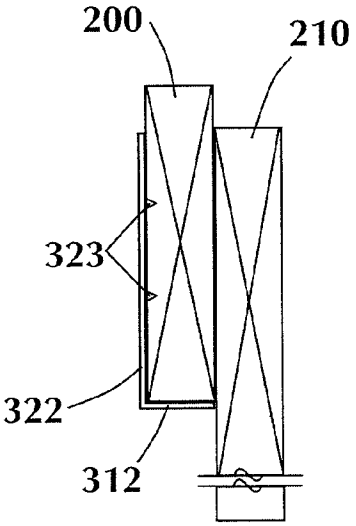
FIG. 8A depicts a side view of a heel joint including the fastener guide of the present invention as shown in FIG. 8, set in place using placement teeth.

FIG. 8 shows another embodiment of the fastener guide of the present invention, wherein the fastener guide is fabricated separately as a single use device which is non-structural, and as such, can either be left in place after being used to position fasteners to secure a pair of structural members or can be removed and discarded. The fastener guide may be comprised of any generally flat, rigid material such as light gage sheet steel, aluminum, plastic or plastic-based composite material, paper or paper-based composite material, or any suitable material rigid enough to retain its shape when placed against the face of a structural member. As shown in FIG. 8, the fastener guide 300 may be comprised of a plastic or plastic-based composite material and includes a plurality of through-holes 324 for driving fasteners therethrough to secure a first structural member to a second structural member (not shown). Fastener guide 300 may include a second generally flat, rigid member or flange 312 attached to or integral with a vertical leg 322 and positioned approximately at a right angle thereto. Flange 312 may have a length equal to the length of vertical leg 322, or may be spaced in sections of shorter length, and may have a width less than or equal to the thickness of the first structural member (FIG. 8A). Flange 312 is generally comprised of the same material as the fastener guide vertical leg 322. The through-holes 324 in vertical leg 322 are spaced according to a calculated matrix to allow for transfer of thrust, tension and shear forces from the first structural member to the connected second structural member when fasteners are driven therethrough.

As further shown in FIG. 8, the plurality of through-holes may be arranged in a plurality of rows along a longitudinal axis of the vertical leg 322 and may form a substantially pyramidal shape. The size and position of each of the plurality of through-holes are calculated in accordance with design and building code requirements, wherein each through-hole is spaced a first predetermined centerline distance S1 from each adjacent through-hole in the same row and a second predetermined centerline distance S2 from the adjacent through-hole in each adjacent row, the bottom row is spaced a third predetermined centerline distance S3 from a bottom edge of the fastener guide, and the through-hole at the end of each row is spaced a fourth predetermined centerline distance S4 from an adjacent end of the fastener guide, as described above and also shown in FIG. 7. S1, S2, S3 and S4 are calculated to allow for transfer of thrust, tension and shear forces from the first structural member to the second structural member when fasteners are driven through the plurality of through-holes, and may be calculated in accordance with accepted industry and building code guidelines, such as the International Residential Code®, International Building Code® and National Design Specification® for Wood Construction. The size, spacing and layout of each of the fasteners is dependent upon the type of joint being secured. Moreover, the number of fasteners required at a particular joint is determined by design and code requirements, and not by the actual number of through-holes in the fastener guide. International Residential Code®, International Building Code® and National Design Specification® for Wood Construction requirements include provisions for spacing between individual fasteners in the same row (S1) and between adjacent rows (S2), as well as edge clearance (S3) and end distance (S4), as described above. The layout of the through-holes ensures that fasteners will be placed to meet spacing and positioning requirements in each direction in accordance with design and code requirements for transferring thrust, tension and shear forces to the connected structural members, and for providing proper load capacities.

As shown on the left side of FIG. 8, the fastener guide vertical leg 322 may include one or more placement teeth 323 capable of piercing the first structural member to provide temporary stability while the first structural member is fastened to the second structural member. The vertical leg 322 may further include an adhesive (shown in FIG. 8 as a pair of adhesive strips 325) on at least one surface for securing the vertical leg to a face of the first structural member during fastener placement. To prevent adhesive 325 from drying out, the fastener guide 300 may include a protective covering or strip 326 over the surface area which includes the adhesive. The protective covering or strip is peeled away or removed prior to placement of the fastener guide at the desired location on the face of the first structural member.

FIG. 8A depicts an embodiment of the fastener guide of the present invention, as shown in FIG. 8, wherein the vertical leg 322 is substantially flush with and secured to the face of rafter 200 by means of placement teeth 323 which pierce rafter 200 at a penetrating dimension not exceeding the width of the rafter. Horizontal flange 312 is substantially flush with the bottom surface of rafter 200 to aid in alignment of the fastener guide 300. Fasteners (not shown) are driven through rafter 200 and into adjacent joist 210 at locations designated by through-holes 324 in vertical leg 322 (as shown in FIG. 8), which have been pre-punched and arranged in a calculated matrix to allow for transfer of thrust, tension and shear forces from rafter 200 to adjacent joist 210 in accordance with building code requirements. FIG. 8B depicts a similar heel joint as that of FIG. 8A; however, the fastener guide vertical leg 322 is instead secured to the face of rafter 200 by means of adhesive strips 325. In either arrangement shown, the fastener guide may be removed, if desired, from the face of the rafter 200 after fasteners have been driven therethrough at the designated locations, as the fastener guide is non-structural and non-load bearing and acts simply as an aid for proper fastener placement.

The fastener guide of the present invention may also be used at building joints other than the heel joint to ensure accurate spacing and alignment of fasteners to secure a pair of oriented structural members, such as at the roof (e.g. connecting a rafter to a chord/tie), walls (e.g. at the top wall plate lap), or to secure beams (e.g. overlapping members). At each of these connections, as described above, building codes such as the International Residential Code® and the International Building Code® (with many States adopting these provisions in their own building codes), and the National Design Specification® for Wood Construction, provide fastener sizing and layout requirements for transferring thrust, tension and shear forces to connected structural members, and for providing proper load capacities. In such connections, the fastener guide may remain in place as positioned after securing the building joint, as the fastener guide is a non-structural device and will not impact load or force calculations or requirements.

Figure 9B:
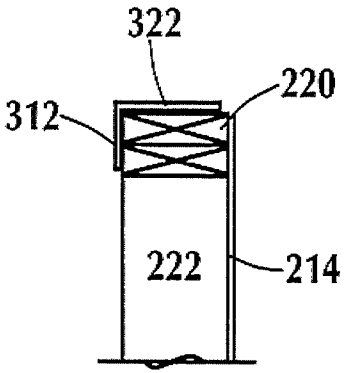
FIG. 9B depicts a cross-sectional view of the building wall of FIG. 9A.
Figure 9A:
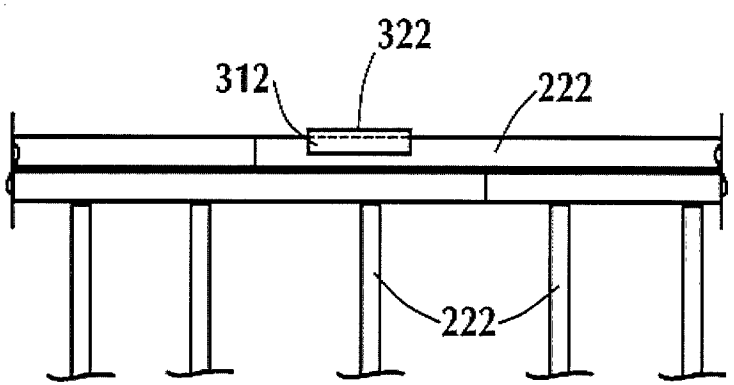
FIG. 9A depicts an elevational view of a building wall including a top wall plate wherein a pair of 2×4's are positioned overlapping and the fastener guide of the present invention is used to set where fasteners are to be properly fastened through the 2×4's in accordance with building code guidelines.

FIGS. 9A and 9B depict an elevational view, and cross-sectional view, respectively, of a building wall including a top wall plate wherein a pair of 2×4's are positioned overlapping and an embodiment of the fastener guide of the present invention is used to set where fasteners are to be properly driven through the 2×4's. As shown in FIGS. 9A and 9B, the fastener guide vertical leg 322 is positioned on a top surface of top wall plate 220, and flange 312 is positioned on an interior face of top wall plate 220. Exterior wall sheathing 214 covers the exterior face of wall plate 220 and studs 222. Fasteners (not shown, for clarity) are driven through top wall plate 220 at locations designated by pre-punched through-holes in vertical leg 322, which have been pre-punched and arranged in a calculated matrix to allow for proper shear load transfer at the wall plate, in accordance with building code requirements. The fastener guide may be removed after securing the connecting structural members, if desired.

Figure 10B:
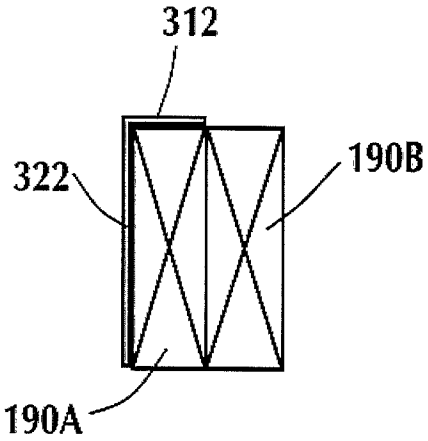
FIG. 10B depicts a cross-sectional view of the continuous beams of FIG. 10A.
Figure 10A:
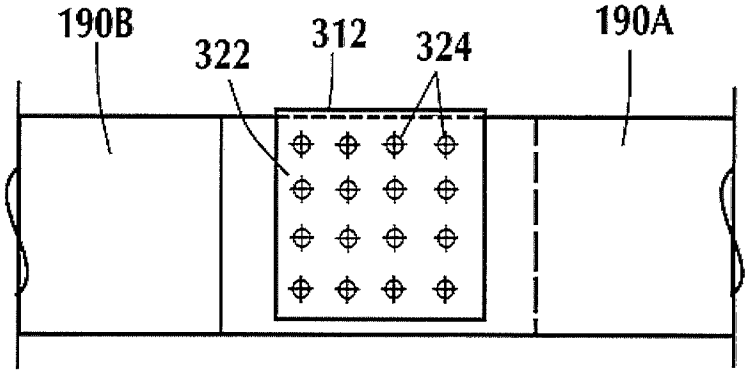
FIG. 10A depicts an elevational view of a pair of continuous beams wherein the fastener guide of the present invention is used to set where fasteners are to be properly fastened through the beams in accordance with building code guidelines.

FIGS. 10A and 10B depict an elevational view, and cross-sectional view, respectively, of a pair of overlapping continuous wood members, wherein an embodiment of the fastener guide of the present invention is used to set where fasteners are to be properly driven through the wood members. As shown in FIGS. 10A and 10B, the fastener guide vertical leg 322 is placed on a face of member 190A opposite adjacent member 190B, and flange 312 is positioned on a top surface thereof. Fasteners (not shown, for clarity) are driven through a plurality of through-holes 324 in vertical leg 322 through beam 190A into overlapping member 190B. The through-holes 324 are arranged in a calculated matrix to allow for transfer of thrust, tension and shear forces from member 190A to adjacent overlapping member 190B in accordance with building code requirements. The fastener guide may be removed after securing the continuous beams 190A, 190B, if desired.

Thus the present invention achieves one or more of the following advantages. The present invention provides a fastener guide for accurate spacing and aligning of fastening means in light wood frame construction. The fastener guide provides for the proper sizing, layout and spacing of fasteners and ensures that fasteners will be placed to meet spacing and positioning requirements in each direction in accordance with design and building code requirements for transferring thrust, tension and shear forces to connected structural members for providing load capacities. In contrast to the connectors of the prior art, the fastener guide of the present invention is a non-structural device, therefore it can be removed and discarded after the installation of fasteners without effecting load or the transfer of various forces between the connected members. The fastener guide allows for a reduction in the time required to secure each building joint, including but not limited to, eliminating the need for interpretation of building code tables for fastener layout, as well as eliminating the time-consuming dimensional hand layout by the craftsman in the field for fastener placement on every related structural member.

While the present invention has been particularly described, in conjunction with specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method for connecting structural members in building structures comprising the steps of:

providing a pair of structural members for connection as part of a building frame;

orienting the pair of structural members at a building frame joint;

providing a fastener guide comprising a vertical leg comprising a generally flat rigid material and including a plurality of through-holes spaced according to a calculated matrix for driving fasteners therethrough to secure the first structural member to the second structural member, and a flange attached to or integral with the vertical leg and positioned approximately at a right angle thereto;

placing the fastener guide against a face of the first structural member such that the vertical leg plurality of through-holes are positioned to allow for transfer of thrust, tension and shear forces to the second structural member when fasteners are driven therethrough;

driving fasteners through the plurality of through-holes into the second structural member; and removing the fastener guide from the face of the first structural member after driving fasteners through the plurality of through-holes into the second structural member.

2. The method of claim 1 wherein the plurality of through-holes are oriented in a plurality of rows along a longitudinal axis of the fastener guide vertical leg.

3. The method of claim 2 wherein each through-hole is spaced a first predetermined centerline distance S1 from each adjacent through-hole in the same row and a second predetermined centerline distance S2 from the adjacent through-hole in each adjacent row, the bottom row is spaced a third predetermined centerline distance S3 from a bottom edge of the fastener guide vertical leg, and the through-hole at the end of each row is spaced a fourth predetermined centerline distance S4 from an adjacent end of the fastener guide vertical leg, wherein S1, S2, S3 and S4 are calculated to allow for total transfer of thrust, tension and shear forces from the first structural member to the second structural member when fasteners are driven through the plurality of through-holes.

4. The method of claim 3 wherein S1, S2, S3 and S4 are calculated for a designated type of joint, species of lumber, desired load capacity, and type and size of fasteners.

5. The method of claim 1 wherein the fastener guide vertical leg includes at least one placement tooth capable of piercing the first structural member having a penetrating dimension not exceeding a width of the first structural member, and further including the step of removably affixing the vertical leg to the first structural member using the at least one placement tooth prior to driving fasteners through the plurality of through-holes into the second structural member.

6. The method of claim 1 wherein the fastener guide vertical leg includes an adhesive on at least one surface for removably affixing the vertical leg to the face of the first structural member and a removable protective covering over the surface area which includes the adhesive, wherein the protective covering is removed prior to placement of the fastener guide against the face of the first structural member, and further including the step of removably affixing the vertical leg to the first structural member using the adhesive prior to driving fasteners through the plurality of through-holes into the second structural member.

* * * * *